US011283172B2

(12) United States Patent
Huang et al.

(10) Patent No.: US 11,283,172 B2
(45) **Date of Patent: *Mar. 22, 2022**

(54) INTEGRATION MODULE SYSTEM OF MILLIMETER-WAVE AND NON-MILLIMETER-WAVE ANTENNAS AND ELECTRONIC APPARATUS

(71) Applicants: ETHETA COMMUNICATION TECHNOLOGY (SHENZHEN) CO., LTD, Shenzhen (CN); EAST CHINA RESEARCH INSTITUTE OF MICROELECTRONICS, Hefei (CN)

(72) Inventors: Huan-Chu Huang, Taoyuan (TW); Jiaguo Lu, Hefei (CN); Hong Lin, Shenzhen (CN); Junyong Liu, Hefei (CN); Zhixing Qi, Shenzhen (CN); Minhui Zeng, Hefei (CN); Yanchao Zhou, Shenzhen (CN); Jingwei Li, Hefei (CN); Tao Ma, Hefei (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/917,503

(22) Filed: Jun. 30, 2020

(65) Prior Publication Data

US 2021/0344115 A1 Nov. 4, 2021

(30) Foreign Application Priority Data

Apr. 30, 2020 (CN) ..... 202010371100.0

(51) Int. Cl.
*H01Q 1/22* (2006.01)
*H01Q 5/335* (2015.01)
(Continued)

(52) U.S. Cl.
CPC ..... *H01Q 5/335* (2015.01); *H01Q 5/50* (2015.01); *H01Q 9/0428* (2013.01); *H01Q 21/065* (2013.01); *H01Q 21/10* (2013.01)

(58) Field of Classification Search
CPC .... H01Q 5/335; H01Q 21/065; H01Q 9/0428; H01Q 21/10; H01Q 5/50; H01Q 1/2283;
(Continued)

(56) References Cited

U.S. PATENT DOCUMENTS 10,892,564 B1 * 1/2021 Huang ..... H01Q 21/065
11,069,988 B1 * 7/2021 Huang ..... H01Q 21/065
(Continued)

*Primary Examiner* — David E Lotter

(57) ABSTRACT

The present invention relates to an integration module system of millimeter-wave and non-millimeter-wave antennas and an electronic apparatus, the system comprising a millimeter-wave antenna module and a non-millimeter-wave environment, the millimeter-wave antenna module forming a communication connection with the non-millimeter-wave environment for realizing reusing of the millimeter-wave antenna module to achieve a function of non-millimeter-wave antenna(s). The present invention proposes directly reusing a millimeter-wave antenna module, which is designed so that this module also has an antenna function of a non-millimeter-wave module, while an individual module's own volume does not need to be increased, and the module itself does not need to have additionally-added antenna traces, that is, with the same volume, a function of non-millimeter-wave antenna(s) may be further added. Therefore, it obviously helps to avoid an increase of the device's volume and improve compactness of the system and system design.

7 Claims, 11 Drawing Sheets

(51) Int. Cl.

| | |
|---|---|
| ***H01Q 5/50*** | (2015.01) |
| ***H01Q 9/04*** | (2006.01) |
| ***H01Q 21/06*** | (2006.01) |
| ***H01Q 21/10*** | (2006.01) |

(58) Field of Classification Search
CPC ..... H01Q 1/38; H01Q 1/243; H01Q 9/0407; H01Q 21/28
See application file for complete search history.

(56) References Cited

U.S. PATENT DOCUMENTS

| | | | | |
|---|---|---|---|---|
| 2019/0020114 | A1* | 1/2019 | Paulotto | H01Q 5/378 |
| 2019/0173195 | A1* | 6/2019 | Kim | H01Q 3/24 |
| 2020/0021009 | A1* | 1/2020 | Huang | H01Q 5/35 |
| 2020/0076452 | A1* | 3/2020 | Dai | H04B 1/006 |
| 2020/0083948 | A1* | 3/2020 | Lim | H01Q 3/2605 |
| 2020/0106157 | A1* | 4/2020 | Tran | H01Q 21/064 |
| 2020/0127361 | A1* | 4/2020 | Lee | H01Q 1/2283 |
| 2020/0136269 | A1* | 4/2020 | Choi | H01Q 9/0414 |
| 2020/0178261 | A1* | 6/2020 | Ioffe | H04W 72/085 |
| 2021/0075088 | A1* | 3/2021 | Edwards | H01Q 1/38 |
| 2021/0098882 | A1* | 4/2021 | Paulotto | H01Q 21/065 |

* cited by examiner

INTEGRATION MODULE SYSTEM OF MILLIMETER-WAVE AND NON-MILLIMETER-WAVE ANTENNAS AND ELECTRONIC APPARATUS

CROSS-REFERENCE TO RELATED APPLICATION

This application claims priority to and the benefit of Chinese Patent Application No. 2020103711000 filed Apr. 30, 2020, the contents of which is incorporated herein by reference in its entirety.

FIELD OF THE INVENTION

The present invention relates to the field of antenna technology, and in particular to an integration module system of millimeter-wave and non-millimeter-wave antennas and an electronic apparatus.

BACKGROUND OF THE INVENTION

With the arrival of the 5G age, due to the requirements for higher-order multiple-input and multiple-output (MIMO) communications, the requirements for coverage of more new frequency bands, and even the addition of millimeter wave bands, a greater number of antennas (comprising millimeter-wave and non-millimeter-wave antennas) are required. Nevertheless, it results in higher difficulty in antenna design in the case where the space of a whole device cannot be significantly increased. Furthermore, the size of the whole device will be even increased due to the insufficiently compact antenna arrangement or design, resulting in a decline in product competitiveness. The 5G frequency bands are divided into millimeter wave bands and non-millimeter wave bands. At present, the mainstream antenna design scheme for non-millimeter wave bands is to have separate antennas, and the mainstream implementation types comprise stamped iron sheet, flexible printed circuit (FPC), laser direct structuring (LDS), printed direct structuring (PDS), etc.; and the current mainstream antenna design scheme for millimeter wave bands is the integrated antenna-in-package (AiP), that is, an antenna (or antennas) and a chip, especially a radio frequency chip, i.e., a radio frequency integrated circuit (RFIC), are integrated into a packaged antenna module. As mentioned above, the number of antennas has been increased significantly in the 5G age, and thus a 5G device requires multiple separate 5G non-millimeter-wave antennas and several 5G millimeter-wave antenna modules (if the device can support millimeter wave band communications).

Therefore, in view of this, a Chinese patent CN201910760335.6 proposes a scheme of an integration module of millimeter-wave and non-millimeter-wave antennas; however, the technical contents disclosed in the independent claims of the patent are as follows: ① millimeter-wave antennas are dipole antennas; and ② a substrate comprises a floor, a first dielectric layer and a second dielectric layer, and the first dielectric layer and the second dielectric layer are respectively located on two sides of the floor; a radio frequency chip is provided on the first dielectric layer, and the radio frequency chip is connected to a feeding structure of N dipole antenna units; and a non-millimeter-wave antenna is provided on the second dielectric layer. Therefore, what is protected by this patent is that the radio frequency chip and the non-millimeter-wave antenna are parallel and provided on different layers.

In view of the above, it results in higher difficulty in antenna design or higher cost in the case where the space of a whole device cannot be significantly increased but there are requirements for communications which result in the need to accommodate more 5G (millimeter-wave and non-millimeter-wave) antennas. Furthermore, the size of the whole device will be even increased due to the insufficiently compact antenna arrangement or design, resulting in a decline in product competitiveness. The Chinese patent CN201910760335.6 proposes adding non-millimeter-wave antenna traces to a module so that millimeter-wave and non-millimeter-wave antennas are integrated on one module, but this design will occupy a larger area in a horizontal plane.

SUMMARY OF THE INVENTION

The present invention is exactly aimed at the above existing problems, and the present invention provides an integration module system of millimeter-wave and non-millimeter-wave antennas and an electronic apparatus.

To achieve the above object, the specific technical solution of the present invention is as follows:

an integration module system of millimeter-wave and non-millimeter-wave antennas comprises a millimeter-wave antenna module and a non-millimeter-wave environment, and the millimeter-wave antenna module forms a communication connection with the non-millimeter-wave environment for realizing reusing of the millimeter-wave antenna module to achieve a function of non-millimeter-wave antenna(s).

As a preferred technical solution of the present invention, the millimeter-wave antenna module comprises a module carrier, one or more millimeter-wave antennas, and a millimeter-wave radio frequency chip, and the millimeter-wave radio frequency chip is electrically connected to the millimeter-wave antenna(s).

As a preferred technical solution of the present invention, the non-millimeter-wave environment comprises feeding line(s) for one or more non-millimeter-wave antennas and feeding source(s) for non-millimeter-wave antenna(s), and the feeding source(s) for non-millimeter-wave antenna(s) forms a communication connection with the millimeter-wave antenna module via the feeding line(s) for the non-millimeter-wave antenna(s) for realizing reusing of the millimeter-wave antenna module to achieve the function of non-millimeter-wave antenna(s).

As a preferred technical solution of the present invention, the communication connection is an electrical connection, or a coupling connection, or an inductive connection.

As a preferred technical solution of the present invention, the module carrier is provided thereon with a conductive region, which makes an electrical connection, or a coupling connection, or an inductive connection with the feeding line(s) for the non-millimeter-wave antenna(s); and this conductive region is electrically conductive to a conductive ground or a conductive mechanism in the millimeter-wave antenna module.

As a preferred technical solution of the present invention, the feeding line(s) for the non-millimeter-wave antenna(s) is further provided thereon with a matching network and/or a frequency tuning network for non-millimeter-wave antenna(s).

As a preferred technical solution of the present invention, the system is further provided with a thermally conductive or electrically conductive material for conducting heat from a high-heat region of the system to the outside.

As a preferred technical solution of the present invention, the system further comprises other chips which, together with the millimeter-wave radio frequency chip, is the high-heat region, and the other chips are selected from any one or more of a power management chip, an operation processing chip, and a data storage chip.

The millimeter-wave antenna module of the present invention comprises millimeter-wave antenna(s) or an array constituted by the millimeter-wave antenna(s) (which may be a linear array, a square array, a rectangular array, a triangular array, a circular array, or a non-equidistant arbitrarily shaped array, etc.), and may also constitute more than one antenna array, and thus the number of the millimeter-wave antenna(s) may be one or more, and the millimeter-wave antenna(s) may be in various forms of a single linearly-polarized antenna, a dual linearly-polarized antenna, a single circularly-polarized antenna, or a dual circularly-polarized antenna, etc. working in a single band or multiple bands, e.g., a monopole antenna, a dipole antenna, a patch antenna, a stacked patch antenna, an inverted F antenna (IFA), a planar inverted F antenna (PIFA), a Yagi-Uda antenna, a slot antenna, a magnetic-electric dipole antenna, a horn antenna, a loop antenna, a grid antenna, a cavity-backed antenna, etc. More than two (including two) millimeter-wave antennas may be different from each other as to antenna form, and more than three (including three) millimeter-wave antennas may be unequal as to spacing thereof, and the millimeter-wave antennas may be distributed on various surfaces of the module (that is, the millimeter-wave antennas are not limited to being distributed on a single surface of the module).

The number of the non-millimeter-wave antenna(s) whose function is achieved by reusing the millimeter-wave antenna module may be one or more. The non-millimeter-wave antenna(s) may also be in the form of a monopole antenna, a dipole antenna, a patch antenna, a stacked patch antenna, an inverted F antenna (IFA), a planar inverted F antenna (PIFA), a Yagi-Uda antenna, a slot antenna, a magnetic-electric dipole antenna, a horn antenna, a loop antenna, a grid antenna, and a cavity-backed antenna, the reused module can achieve more than one non-millimeter-wave antenna, and these multiple non-millimeter-wave antennas do not necessarily need to be in the same form. The shape of this millimeter-wave antenna module may be any shape such as square, rectangle, triangle, trapezoid, L-shape, T-shape, V-shape, U-shape, "concave" shape, "convex" shape, "mouth" shape, circle, ellipse, arc, etc. The material of the antenna module of the present invention comprises, but is not limited to, ceramic (e.g., ceramic types like low-temperature co-fired ceramic (LTCC), or high-temperature co-fired ceramic (HTCC), etc.), a printed circuit board (PCB), a flexible circuit board (FPC) (comprising liquid crystal polymer (LCP) or modified PI (MPI), etc.).

The present invention further provides an electronic apparatus employing the above integration module system of antennas, the millimeter-wave antenna module being provided thereon with a connecting base, the connecting base being connected to a mainboard of the electronic apparatus, wherein the non-millimeter-wave environment is provided on the mainboard of the electronic apparatus.

The present invention proposes directly reusing a millimeter-wave antenna module, which is designed so that this module also has an antenna function of a non-millimeter-wave module, while an individual module's own volume does not need to be increased, and the module itself does not need to have an additionally-added antenna trace, that is, with the same volume, a function of a non-millimeter-wave antenna can be further added. Therefore, it obviously helps avoid an increase of the device's volume and improve compactness of the system and system design, and as compared with the design proposed by the Chinese patent CN201910760335.6, the present invention can make full use of the height space on sides of a mobile phone, and thus will not occupy a larger area in a horizontal plane, hence improving the product's comprehensive competitiveness.

DETAILED DESCRIPTION OF THE INVENTION

In order to enable those ordinarily skilled in the art to be able to understand and implement the present invention, examples of the present invention will be further described below in conjunction with the accompanying drawings.

With reference made to FIGS. 1A to 11B, the present invention provides an integration module system of millimeter-wave and non-millimeter-wave antennas, which comprises a millimeter-wave antenna module 1 and a non-millimeter-wave environment 2, and the millimeter-wave antenna module 1 forms a communication connection with the non-millimeter-wave environment 2 for realizing reusing of the millimeter-wave antenna module 1 to achieve a function of non-millimeter-wave antenna(s).

Example One

Figure 1A:
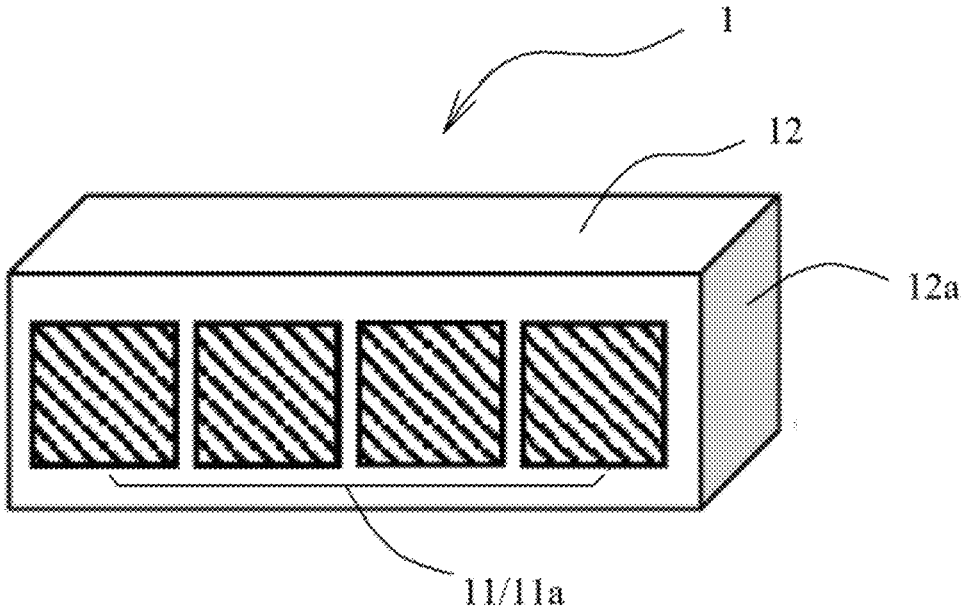
FIG. 1A is a front view and FIG. 1B is a rear view of a millimeter-wave antenna module of Example One of the present invention.
Figure 1B:
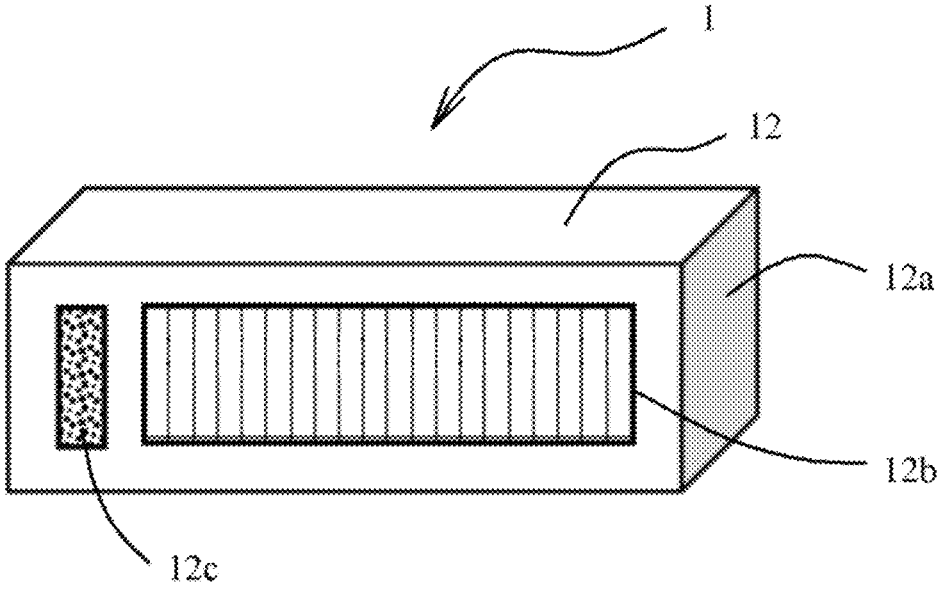
Figure 2A:
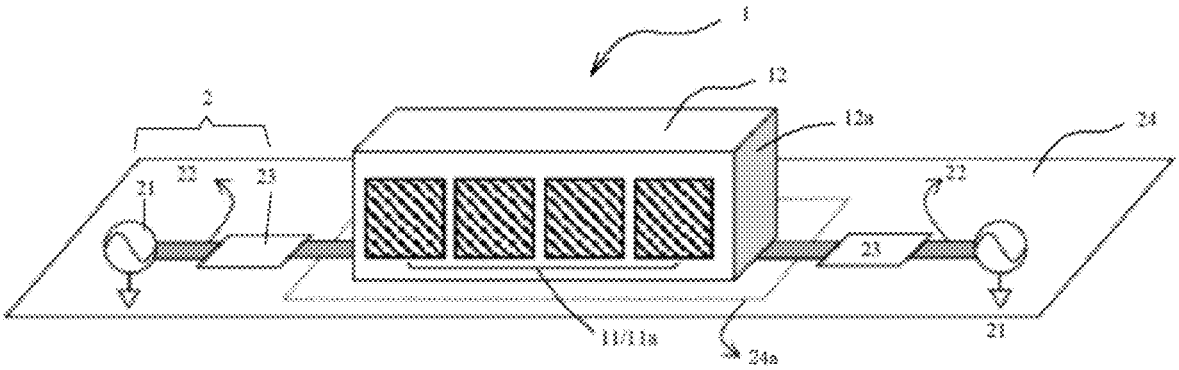
FIG. 2A is a front view and FIG. 2B is a rear view of an integration module system of millimeter-wave and non-millimeter-wave antennas of Example One of the present invention.
Figure 2B:
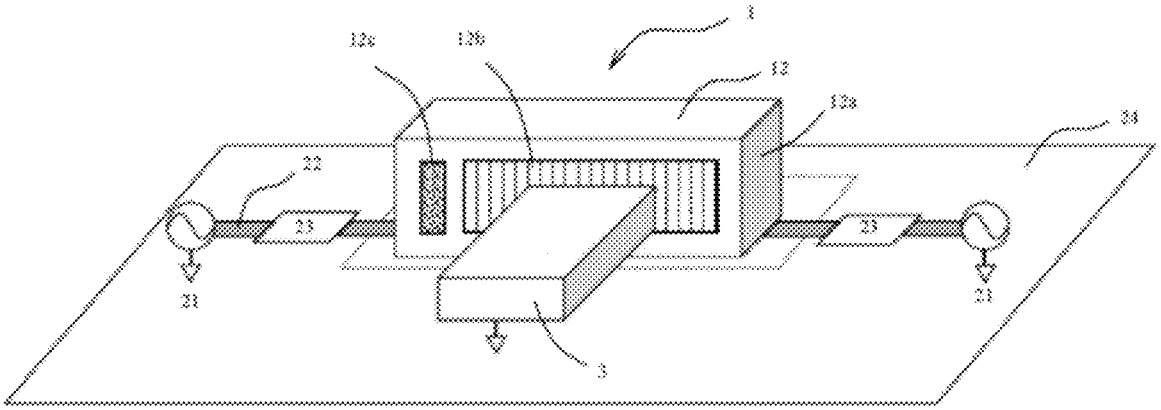

As shown in Example One and FIG. 1A and FIG. 1B, a millimeter-wave antenna module 1 in this example has (but is not limited to) a one-dimensional linear array formed by four millimeter-wave antennas 11, and the millimeter-wave antenna array 11*a* is mainly provided on a front long-side vertical face (i.e., on a front face) of a module carrier 12. On a rear long-side vertical face (i.e., on a back face) of the module carrier 12, a chip (comprising chip(s) like a radio frequency chip, i.e., a RFIC, or the former plus a power management IC, i.e., a PMIC, etc.), and/or associated electronic components, and/or a chip shielding facility (e.g., a shielding cover or a shielding layer), and/or a connecting base (connector or socket), etc. may be placed. A radio frequency path of the radio frequency chip is electrically connected to feeding ports of the millimeter-wave antennas 11.

The millimeter-wave antennas 11 may be in various antenna forms described above, and a size of each millimeter-wave antenna is preferably not greater than 2 equivalent guided wavelengths at its lowest operating frequency, and a spacing of the millimeter-wave antennas is preferably not greater than 2 free-space wavelengths at its lowest operating frequency. Two short-side vertical faces (or a part thereof) of the millimeter-wave antenna module 1 in this example are conductive walls or conductive regions 12*a*, a non-millimeter-wave feeding source 21 can be fed into two side walls of the millimeter-wave antenna module 1 through an electrical connection via an antenna feeding line 22 (with a matching network 23, and/or a frequency tuning network), and these conductive walls or conductive regions 12*a* are electrically conductive to a conductive ground or a conductive structure (preferably a metal ground or a metal structure) in the module carrier 12. In this way, the millimeter-wave antenna module 1 can have the function of (two) non-millimeter antennas 11, realizing an integration module scheme that achieves a more spatially compact and functionally comprehensive design and hence can cover millimeter wave bands and (multiple) non-millimeter wave bands of 5G without additionally adding space and cost and with the development difficulty reduced. In addition, in order to strengthen heat dissipation, an electrically conductive or thermally conductive material 3 may be added to be connected to the shielding cover or shielding layer 12*b* of a chip region to conduct and remove heat from the chip region to the outside. The system setting diagrams of this integration module are shown as FIG. 2A and FIG. 2B.

In the example of the present invention, the non-millimeter-wave environment 2 comprising the non-millimeter-wave feeding source 21, the feeding line(s) 22 for the non-millimeter-wave antenna(s), and matching network(s) 23 (and/or frequency tuning network(s)) for non-millimeter-wave antenna(s) is preferably configured on a mainboard 24 of PCB, and through a combination of the mainboard 24 of PCB, the millimeter-wave antenna module 1 and the non-millimeter-wave environment 2, an electronic apparatus that reuses the millimeter-wave antenna module 1 to achieve the function of non-millimeter-wave antenna(s) can be provided. At this time, a coverage region of the module carrier 12 of the millimeter-wave antenna module 1 and its extension region on the mainboard 24 of PCB are set as a clearance region 24*a* of the millimeter-wave antenna module 1 without copper plating, and the module carrier 12 is provided thereon with an electric connecting base 12*c*, which is electrically connected to the mainboard of the electronic apparatus.

Example Two

Figure 3A:
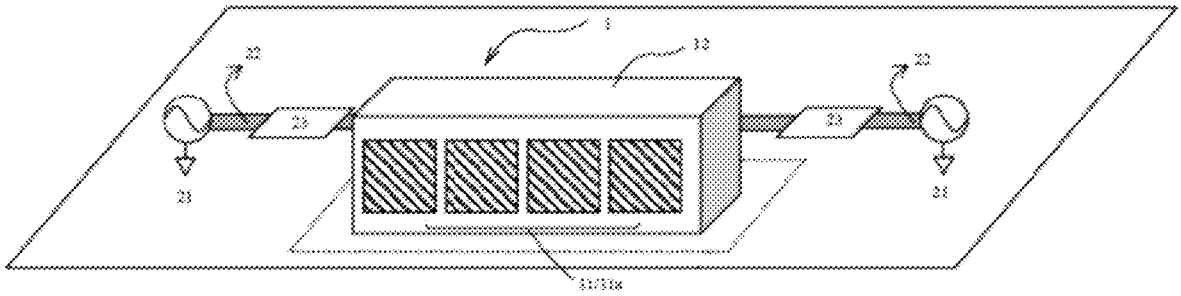
FIG. 3A is a front view and FIG. 3B is a rear view of an integration module system of millimeter-wave and non-millimeter-wave antennas of Example Two of the present invention.
Figure 3B:
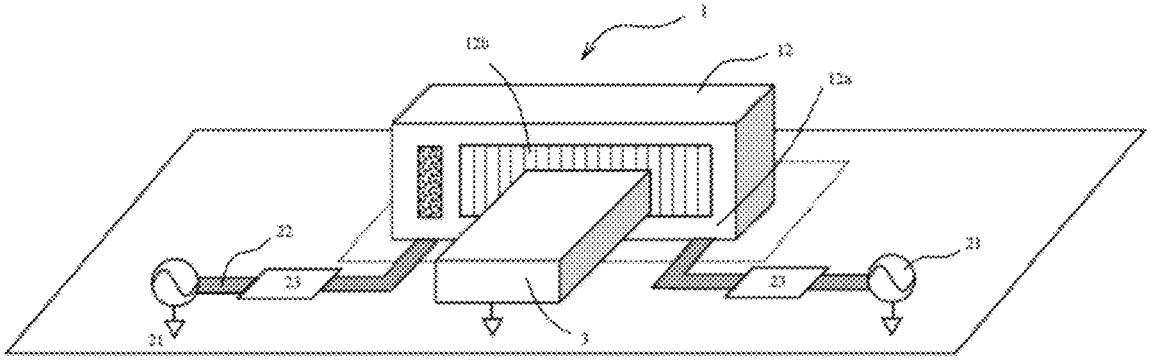

As shown in Example Two of FIG. 3A and FIG. 3B, the example differs from Example One in that: a back long-side vertical face (or a part thereof) of a millimeter-wave antenna module 1 in this example is a conductive wall or a conductive region 12*a*, a non-millimeter-wave feeding source 21 can be fed into this side wall of the millimeter-wave antenna module 1 through an electrical connection via an antenna feeding line 22 (with a matching network 23, and/or a frequency tuning network), and this conductive wall or conductive region 12*a* is electrically conductive to a conductive ground or a conductive structure (preferably a metal ground or a metal structure) in the module. In this way, the millimeter-wave antenna module 1 can have the function of (two) non-millimeter antennas, realizing an integration module scheme that achieves a more spatially compact and functionally comprehensive design and hence can cover millimeter wave bands and (multiple) non-millimeter wave bands of 5G without additionally adding space and cost and with the development difficulty reduced. In addition, in order to strengthen heat dissipation, an electrically conductive or thermally conductive material 3 may be added to be connected to a chip region's shielding cover or shielding layer 12*b* to conduct and remove heat from the chip region to the outside. The system setting diagram of this integration module is shown as FIG. 3.

Example Three

Figure 4:
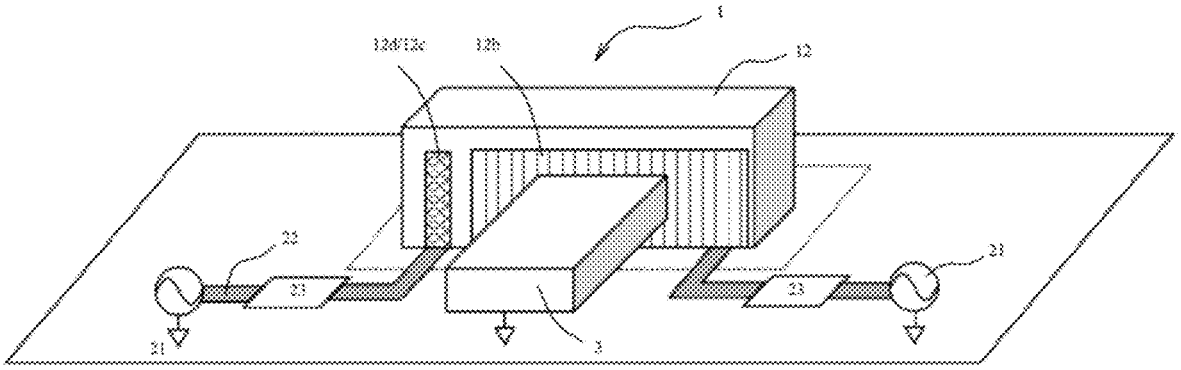
FIG. 4 is a rear view of an integration module system of millimeter-wave and non-millimeter-wave antennas of Example Three of the present invention.

As shown in Example Three of FIG. 4, the differences between this example and Example Two are as follows: a non-millimeter-wave feeding source 21 can be fed into a shielding cover or shielding layer 12*b* of a millimeter-wave antenna module 1 and a connector 12*d* (which is a conductive part covering a connecting base 12*c*) in a snap-fit relationship with the connecting base 12*c* through an electrical connection via an antenna feeding line 22 (with a matching network 23, and/or a frequency tuning network), and this shielding cover or shielding layer 12*b* and the connector 12*d* (which is a conductive part) on the connecting base 12*c* are electrically conductive to a conductive ground or a conductive structure (preferably a metal ground or a metal structure) in the module carrier 12. In this way, the millimeter-wave antenna module 1 can have the function of (two) non-millimeter antennas, realizing an integration module scheme that achieves a more spatially compact and functionally comprehensive design and hence can cover millimeter wave bands and (multiple) non-millimeter wave bands of 5G without additionally adding space and cost and with the development difficulty reduced. In addition, in order to strengthen heat dissipation, an electrically conductive or thermally conductive material 3 may be added to be connected to the shielding cover or shielding layer 12*b* of a chip region to conduct and remove heat from the chip region to the environment and system. The system setting diagram of this integration module is shown as FIG. 4.

Example Four

Figure 5:
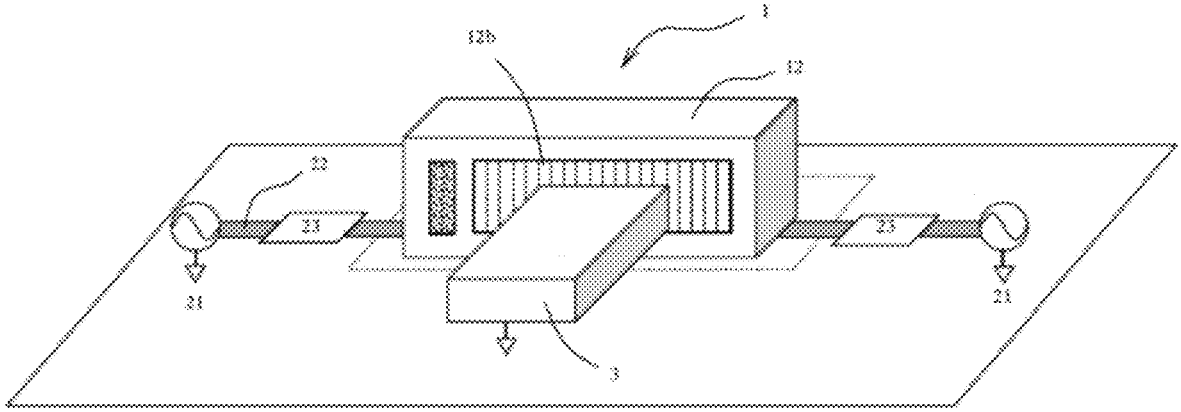
FIG. 5 is a rear view of an integration module system of millimeter-wave and non-millimeter-wave antennas of Example Four of the present invention.

As shown in Example Four of FIG. 5, the differences between this example and Example One are as follows: a bottom surface (or a part thereof) of a millimeter-wave antenna module 1 in this example is a conductive wall or a conductive region (not shown in the figure), a non-millimeter-wave feeding source 21 can be fed into the bottom surface of the millimeter-wave antenna module 1 through an electrical connection via an antenna feeding line 22 (with a matching network 23), and this conductive wall or conductive region is electrically conductive to a metal ground or a metal structure in the module carrier 12. In this way, the millimeter-wave antenna module 1 can have the function of (two) non-millimeter antennas, realizing an integration module scheme that achieves a more spatially compact and functionally comprehensive design and hence can cover millimeter wave bands and (multiple) non-millimeter wave bands of 5G without additionally adding space and cost and with the development difficulty reduced. In addition, in order to strengthen heat dissipation, an electrically conductive or thermally conductive material 3 may be added to be connected to a chip region's shielding cover or shielding layer 12*b* to conduct and remove heat from the chip region to the outside.

Example Five

Figure 6:
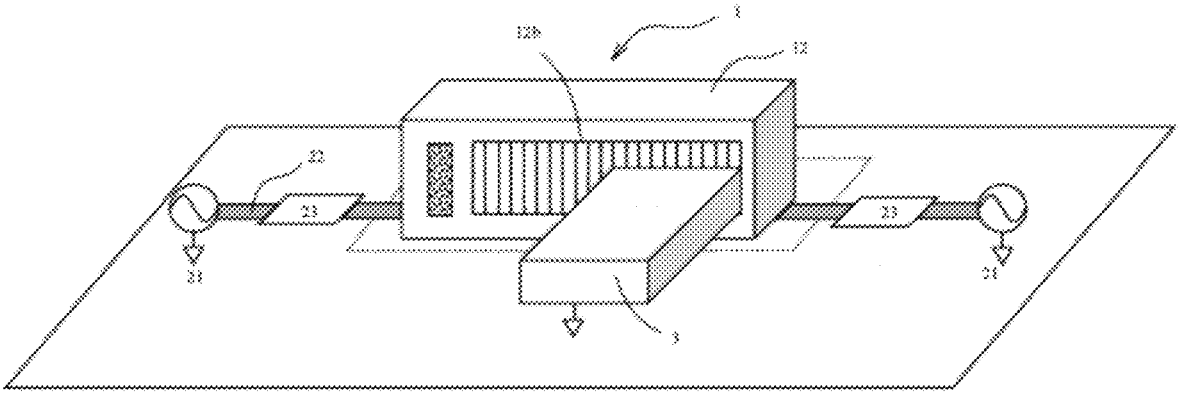
FIG. 6 is a rear view of an integration module system of millimeter-wave and non-millimeter-wave antennas of Example Five of the present invention.

As shown in Example Five of FIG. 6, the difference between this example and Example One is that an electrically conductive or thermally conductive material 3 may be placed significantly eccentrically to reach multiple antennas with different frequency coverage.

Example Six

Figure 7A:
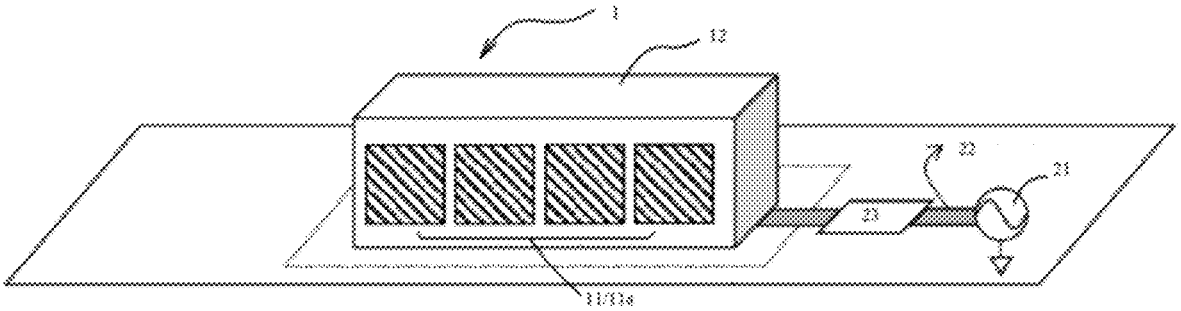
FIG. 7A is a front view and FIG. 7B is a rear view of an integration module system of millimeter-wave and non-millimeter-wave antennas of Example Six of the present invention.
Figure 7B:
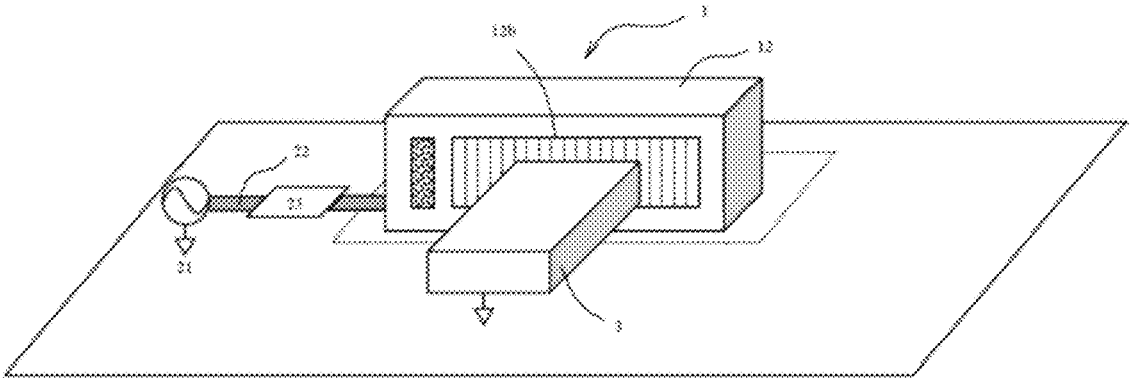

As shown in Example Six of FIG. 7A and FIG. 7B, the difference between this example and Example One is that a short-side vertical face (or a part thereof) of a millimeter-wave antenna module in this example is a conductive wall or a conductive region.

Example Seven

Figure 8:
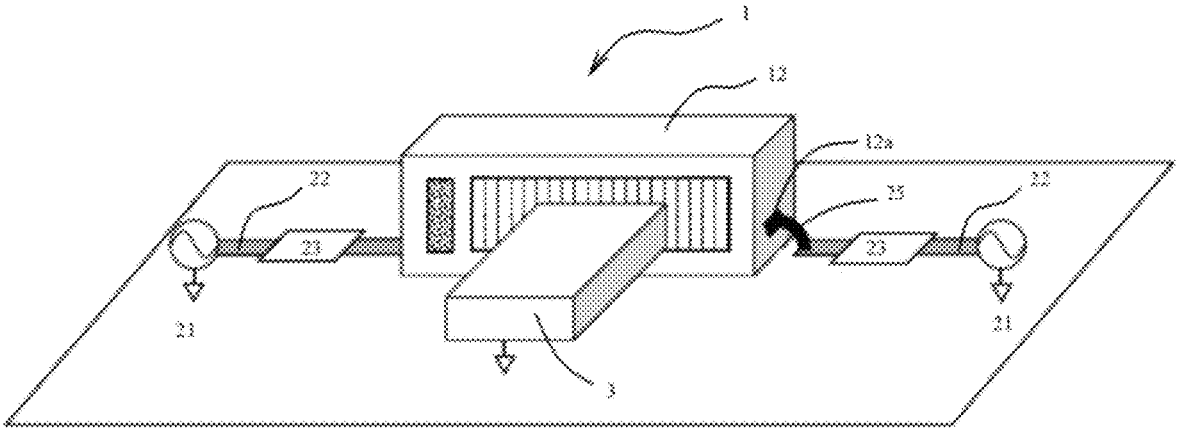
FIG. 8 is a rear view of an integration module system of millimeter-wave and non-millimeter-wave antennas of Example Seven of the present invention.

As shown in Example Seven of FIG. 8, the differences between this example and Example One are as follows: two short-side vertical faces (or a part thereof) of a millimeter-wave antenna module 1 in this example have conductive regions 12*a*, a non-millimeter-wave feeding source 21 can be fed into the conductive regions 12*a* of the two side walls of the millimeter-wave antenna module 1 through an electrical connection mechanism (e.g., a spring 25) via an antenna feeding line 22 (and a matching network 23), and the conductive regions 12*a* are electrically conductive to a metal ground or a metal structure in the module carrier 12. In this way, the millimeter-wave antenna module 1 can have the function of (multiple) non-millimeter antennas, and a clearance region on the antenna module's board can be eliminated, realizing an integration module scheme that achieves a more spatially compact and functionally comprehensive design and hence can cover millimeter wave bands and (multiple) non-millimeter wave bands of 5G without additionally adding space and cost and with the development difficulty reduced.

Example Eight

Figure 9:
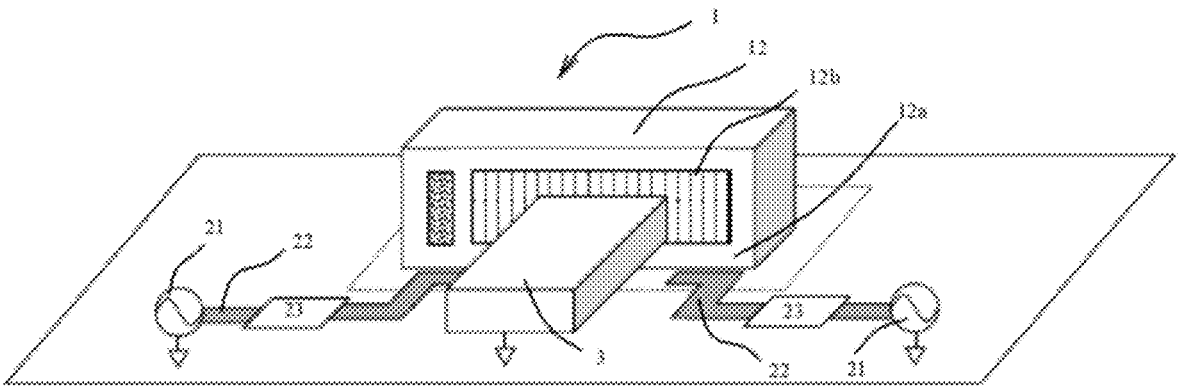
FIG. 9 is a rear view of an integration module system of millimeter-wave and non-millimeter-wave antennas of Example Eight of the present invention.

As shown in Example Eight of FIG. 9, the differences between this example and Example Two are as follows: a non-millimeter-wave feeding source 21 can feed energy into a millimeter-wave antenna module 1 by means of coupling (not an electrical connection) with a conductive wall or conductive region 12*a* of a side wall of the module via an antenna feeding line 22 (with a matching network 23), a spacing between the antenna feeding line and the antenna module is preferably not greater than one free-space wavelength, and this conductive wall or conductive region 12*a* is electrically conductive to a metal ground or a metal structure in the module carrier 12. In this way, the millimeter-wave antenna module can have the function of (two) non-millimeter antennas, realizing an integration module scheme that achieves a more spatially compact and functionally comprehensive design and hence can cover millimeter wave bands and (multiple) non-millimeter wave bands of 5G without additionally adding space and cost and with the development difficulty reduced. In addition, in order to strengthen heat dissipation, an electrically conductive or thermally conductive material 3 may be added to be connected to a chip region's shielding cover or shielding layer 12*b* to conduct and remove heat from the chip region to the outside.

Example Nine

Figure 10A:
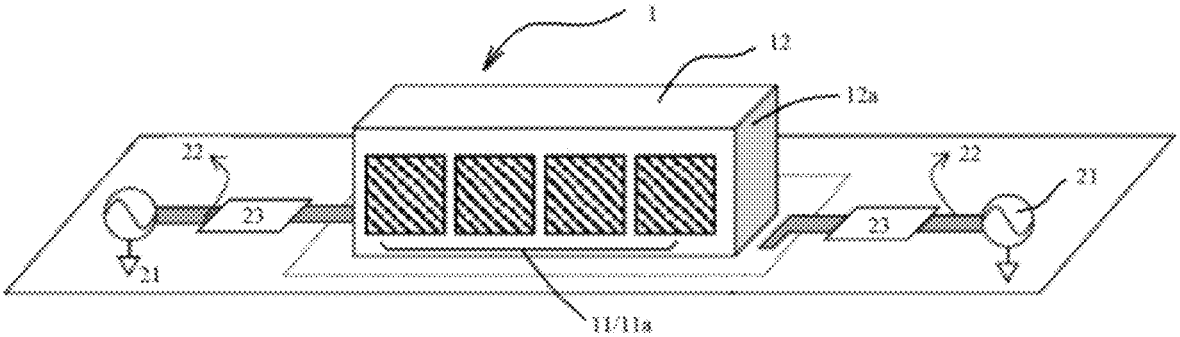
FIG. 10A is a front view and FIG. 10B is a rear view of an integration module system of millimeter-wave and non-millimeter-wave antennas of Example Nine of the present invention.
Figure 10B:
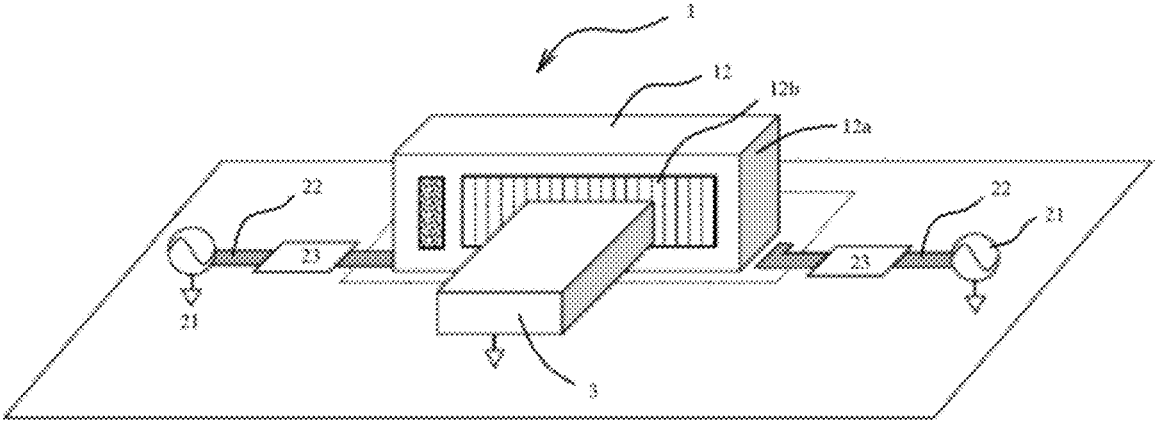

As shown in Example Nine of FIG. 10, the differences between this example and Example One are as follows: a non-millimeter-wave feeding source 21 can feed energy into a millimeter-wave antenna module 1 by means of coupling (not an electrical connection) with a conductive wall or conductive region 12*a* of a side wall of the millimeter-wave antenna module 1 via an antenna feeding line 22 (with a matching network 23), a spacing between the antenna feeding line and the antenna module is preferably not greater than one free-space wavelength, and this conductive wall or conductive region 12*a* is electrically conductive to a metal ground or a metal structure in the millimeter-wave antenna module 1. In this way, the millimeter-wave antenna module 1 can have the function of (two) non-millimeter antennas, realizing an integration module scheme that achieves a more spatially compact and functionally comprehensive design and hence can cover millimeter wave bands and (multiple) non-millimeter wave bands of 5G without additionally adding space and cost and with the development difficulty reduced. In addition, in order to strengthen heat dissipation, an electrically conductive or thermally conductive material 3 may be added to be connected to a chip region's shielding cover or shielding layer 12*b* to conduct and remove heat from the chip region to the outside.

Example Ten

Figure 11A:
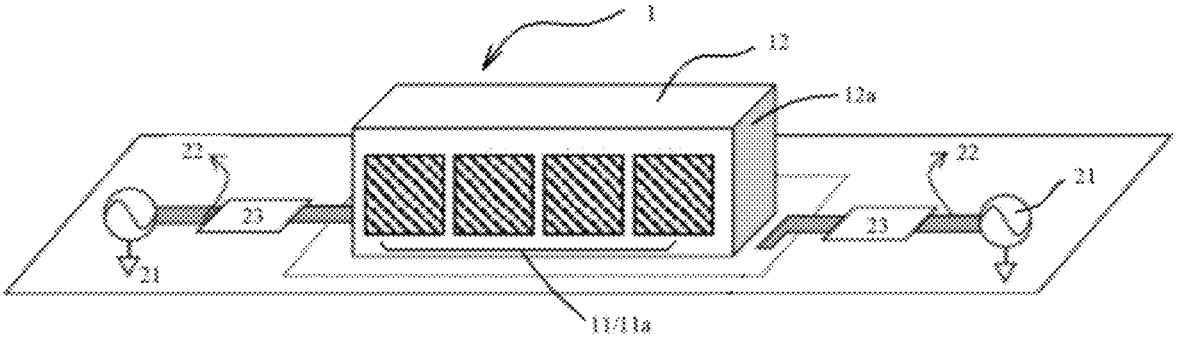
FIG. 11A is a front view and FIG. 11B is a rear view of an integration module system of millimeter-wave and non-millimeter-wave antennas of Example Ten of the present invention.
Figure 11B:
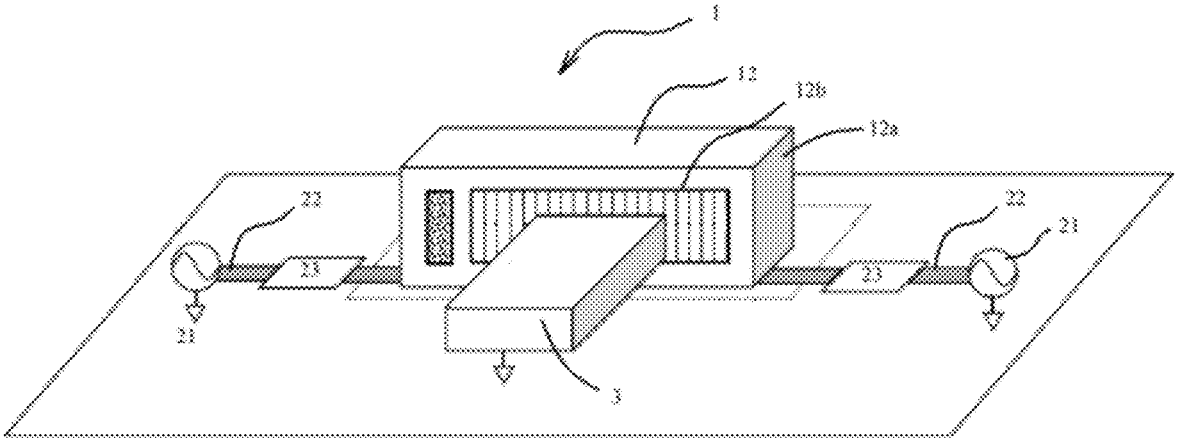

As shown in Example Ten of FIG. 11, the differences between this example and Example Nine are as follows: one non-millimeter-wave feeding source 21 can feed energy into a millimeter-wave antenna module 1 by means of coupling (not an electrical connection) with a conductive wall or conductive region 12*a* of a side wall of the millimeter-wave antenna module 1 via an antenna feeding line 22 (with a matching network 23), a spacing between the antenna feeding line and the antenna module is preferably not greater than one free-space wavelength, another non-millimeter-wave feeding source 21 can be fed into a conductive side wall or conductive region 12*a* of the millimeter-wave antenna module 1 through an electrical connection mechanism via an antenna feeding line 22 (with a matching network 23), and these conductive walls or conductive regions are electrically conductive to a metal ground or a metal structure in the module. In this way, the millimeter-wave antenna module 1 can have the function of (two) non-millimeter antennas, and because these two antennas are designed in different forms, these two antennas have higher isolation, which is beneficial to improvement in performance of a radio frequency link and radiation characteristics of wireless transmission, and besides, an integration module scheme that achieves a more spatially compact and functionally comprehensive design and hence can cover millimeter wave bands and (multiple) non-millimeter wave bands of 5G is realized without additionally adding space and cost and with the development difficulty reduced. In addition, in order to strengthen heat dissipation, an electrically conductive or thermally conductive material 3 may be added to be connected to a chip region's shielding cover or shielding layer 12*b* to conduct and remove heat from the chip region to the outside.

The examples described above only express several embodiments of the present invention, and the description thereof is relatively specific and detailed, but it cannot thus be understood as a limitation to the scope of the present invention. It should be pointed out that for those ordinarily skilled in the art, without departing from the concept of the present invention, several variants and improvements can be further made, which all fall within the protection scope of the present invention. Therefore, the protection scope of the present invention shall be subject to the appended claims.

The invention claimed is:

1. An integration module system of millimeter-wave and non-millimeter-wave antennas comprising a millimeter-wave antenna module and a non-millimeter-wave environment, characterized in that the millimeter-wave antenna module comprising a module carrier, one or more millimeter-wave antennas, and a conductive region arranged on the module carrier, wherein the non-millimeter-wave environment comprises feeding lines and feeding sources, and does not include a physical non-millimeter-wave antenna, and the feeding sources are fed into two opposite side walls of the millimeter-wave antenna module through an electrical connection via the feeding lines with a matching network, and/or a frequency tuning network to cover non-millimeter-wave bands, and the conductive region is electrically conductive to a conductive ground in the module carrier.

2. The integration module system of millimeter-wave and non-millimeter-wave antennas according to claim 1, wherein the millimeter-wave antenna module comprises a millimeter-wave radio frequency chip, and the millimeter-wave radio frequency chip is electrically connected to the millimeter-wave antenna(s).

3. The integration module system of millimeter-wave and non-millimeter-wave antennas according to claim 2, wherein the system is further provided with a thermally conductive or electrically conductive material for conducting heat from a high-heat region of the system out of the system.

4. The integration module system of millimeter-wave and non-millimeter-wave antennas according to claim 3, wherein the system further comprises other chips which, together with the millimeter-wave radio frequency chip, is the high-heat region, and the other chips are selected from any one or more of a power management chip, an operation processing chip, and a data storage chip.

5. The integration module system of millimeter-wave and non-millimeter-wave antennas according to claim 1, wherein the millimeter-wave antenna(s) is in the form of any one of a single linearly-polarized antenna, a dual linearly-polarized antenna, a single circularly-polarized antenna, or a dual circularly-polarized antenna working in a single band or multiple bands; or the millimeter-wave antenna(s) constitutes more than one millimeter-wave antenna array; and each of the millimeter-wave antenna array(s) is any one of a linear array, a square array, a rectangular array, a triangular array, a circular array, and a non-equidistant array; or the number of the millimeter-wave antenna array(s) is one, and the millimeter-wave antenna array(s) is a one-dimensional linear array, and a size of each millimeter-wave antenna is less than or equal to 2 equivalent guided wavelengths at its lowest operating frequency, a spacing between two adjacent millimeter-wave antennas is less than or equal to 2 free-space wavelengths at its lowest operating frequency.

6. The integration module system of millimeter-wave and non-millimeter-wave antennas according to claim 1, wherein the conductive region is selected from a conductive wall, a shielding cover or a shielding layer of the millimeter-wave antenna module, a connector, a connecting base arranged on a side surface of the module carrier.

7. An electronic apparatus comprising: a mainboard; an integration module system of millimeter-wave and non-millimeter-wave antennas having: a millimeter-wave antenna module; and a non-millimeter-wave environment with no physical non-millimeter-wave antenna, wherein the millimeter-wave antenna module comprises a module carrier, one or more millimeter-wave antennas, and a conductive region arranged on the module carrier, and wherein the non-millimeter-wave environment with no physical non-millimeter-wave antenna comprises feeding lines, and feeding sources, and the feeding sources are fed into two opposite side walls of the millimeter-wave antenna module through an electrical connection via the feeding lines with a matching network, and/or a frequency tuning network to cover non-millimeter-wave bands without including any physical non-millimeter-wave antenna, and the conductive region is electrically conductive to a conductive ground in the module carrier; and a connecting base provided on the millimeter-wave antenna module, wherein the connecting base is connected to the mainboard of the electronic apparatus, and wherein the non-millimeter-wave environment with no physical non-millimeter-wave antenna is provided on the mainboard of the electronic apparatus.

* * * * *